US009397391B2

(12) United States Patent
Hong et al.

(10) Patent No.: US 9,397,391 B2
(45) Date of Patent: Jul. 19, 2016

(54) M-TYPE HEXAFERRITE ANTENNAS FOR USE IN WIRELESS COMMUNICATION DEVICES

(75) Inventors: Yang-Ki Hong, Tuscaloosa, AL (US); Seok Bae, Ansan (KR); Jae-Jin Lee, Tuscaloosa, AL (US)

(73) Assignee: THE BOARD OF TRUSTEES OF THE UNIVERSITY OF ALABAMA, Tuscaloosa, AL (US)

( * ) Notice: Subject to any disclaimer, the term of this patent is extended or adjusted under 35 U.S.C. 154(b) by 361 days.

(21) Appl. No.: 13/885,374

(22) PCT Filed: Nov. 15, 2011

(86) PCT No.: PCT/US2011/060851

§ 371 (c)(1),
(2), (4) Date: Sep. 5, 2013

(87) PCT Pub. No.: WO2012/068158

PCT Pub. Date: May 24, 2012

(65) Prior Publication Data

US 2013/0342414 A1 Dec. 26, 2013

Related U.S. Application Data

(60) Provisional application No. 61/413,866, filed on Nov. 15, 2010.

(51) Int. Cl.
*B05D 5/12* (2006.01)
*H01Q 1/36* (2006.01)
(Continued)

(52) U.S. Cl.
CPC ..... *H01Q 1/364* (2013.01); *H01F 1/348* (2013.01); *H01Q 1/2283* (2013.01); *H01Q 1/38* (2013.01); *Y10T 29/49016* (2015.01)

(58) Field of Classification Search
CPC ..... H01Q 1/38
See application file for complete search history.

(56) References Cited

U.S. PATENT DOCUMENTS 7,482,977 B2 * 1/2009 Kuroda ..... H01Q 1/24 343/700 MS
7,482,997 B2 * 1/2009 Yang et al. ..... 345/30
(Continued)

FOREIGN PATENT DOCUMENTS

CN 101807746 8/2010
EP 1798210 6/2007
(Continued)

OTHER PUBLICATIONS

Harris, et al., "Recent Advances in Processing and Applications of Microwave Ferrites"; J. Magnestism and Magnetic Mat'ls; Jan. 2009; vol. 321; pp. 2035-2047.
(Continued)

*Primary Examiner* — Carol M Koslow
(74) *Attorney, Agent, or Firm* — Maynard Cooper & Gale, P.C.; Jon Holland

(57) ABSTRACT

An antenna is fabricated using an M-type hexaferrite, such as a tin (Sn) and zinc (Zn) substituted M-type strontium hexaferrite (Sn/Zn-substituted SrM: $SrFe_{12-2x}Zn_xSn_xO_{19}$), thereby enabling antenna miniaturization, broad bandwidth, and high gain. In one embodiment, an antenna system has a substrate and a chip antenna formed on the substrate. The system also has a conductive radiator contacting the chip antenna, and the chip antenna comprises an M-type strontium hexaferrite for which Fe cations are substituted with tin (Sn) and zinc (Zn) to achieve soft magnetic properties for the antenna. Thus, the coercivity and permeability are lower and higher, respectively, than those of pure SrM. Such fabricated hexaferrite chip antennas have broadband characteristics and show good radiation performance at various frequencies, including in the GHz frequency range.

4 Claims, 14 Drawing Sheets

(51) Int. Cl.

| | |
|---|---|
| ***H01F 1/34*** | (2006.01) |
| ***H01Q 1/22*** | (2006.01) |
| ***H01Q 1/38*** | (2006.01) |

(56) References Cited

U.S. PATENT DOCUMENTS

| | | | | |
|---|---|---|---|---|
| 2002/0005808 | A1 * | 1/2002 | Ito | H01Q 1/245 343/700 MS |
| 2005/0282043 | A1 | 12/2005 | Yamazaki et al. | |
| 2008/0055178 | A1 | 3/2008 | Kim et al. | |
| 2010/0173101 | A1 | 7/2010 | Harris et al. | |
| 2013/0342414 | A1 | 12/2013 | Hong et al. | |

FOREIGN PATENT DOCUMENTS

| | | | |
|---|---|---|---|
| JP | 2004-339047 | A | 12/2004 |
| JP | 2006-066497 | B2 | 3/2006 |
| WO | 2011014001 | | 2/2011 |
| WO | 2014085659 | | 6/2014 |

OTHER PUBLICATIONS

Iijima, et al., "Millimeter Wave Absorber using M-type Hexagonal Ferrite" IEEE Int. Symposium on Electromag Compat; Aug. 6, 2002; vol. 2; pp. 547-549. On-line download from: http://ieeexplore.ieee.org/xpl/freeabs_all.jsp?arnumber=874679 on Mar. 11, 2012, abstract only.

Fang, H.C., et al., "Low temperature characterization of nano-sized BaFe12-2xZnxSnxO19 particles",Journal of Magnetism and Magnetic Materials, vol. 191, No. 3 (Jan. 15, 1999), pp. 277-281.

Ghasemi, Ali, et al., "The role of cations distribution on magnetic and reflection loss properties of ferrimagnetic SrFe12-x(Sn0.5Zn0.5)xO19", Journal of Applied Physics, vol. 107, No. 9 (Apr. 27, 2010).

European Patent Office, European Search Report for Application No. 11841979.5-1556 / 2640527 PCT/US2011060851, dated Feb. 10, 2016.

* cited by examiner

Total = 24 $Fe^{3+}$ 16 each of ↑ ($12k + 2a + 2b$)

8 each of ↓ ($4f_{VI} + 4f_{VI}$)

= 40 $\mu_B$/unit cell (saturation magnetization)

R (3 oxygen layers) = $(Sr^{2+}Fe_6^{3+}O_{11}^{2-})^{2-}$

S (2 oxygen layers) = $(Fe_6^{3+}O_8^{2-})^{2+}$

Summary of magnetic properties for the synthesized SSZMs.
| | **S1**: 1400 °C 5 h | **S2**: 1450 °C 5 h | **S3: 1450 °C 10 h** | **S4**: 1500 °C 5 h |
|---|---|---|---|---|
| $\sigma$ at 10 kOe (emu/g) | 67.49 | 68.72 | **68.52** | 64.07 |
| $H_c$ (Oe) | 84.76 | 71.92 | **46.07** | 33.89 |
| $H_a$ (kOe) | 6.51 | 6.17 | **4.75** | 3.81 |
| $K_1$ (erg/cm$^3$) | $1.16 \times 10^6$ | $1.12 \times 10^6$ | $\mathbf{0.86 \times 10^6}$ | $0.64 \times 10^6$ |
| $\chi_p$ (emu/g) | $2.175 \times 10^{-5}$ | $1.51 \times 10^{-5}$ | $\mathbf{4.57 \times 10^{-5}}$ | $6.675 \times 10^{-5}$ |
*FIG. 8*
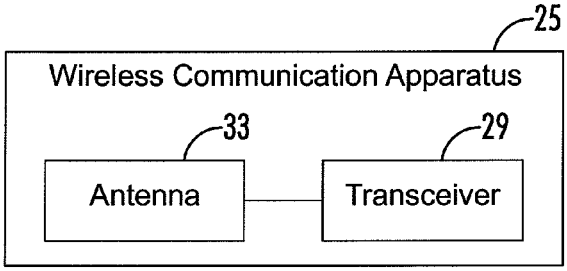
*FIG. 9*
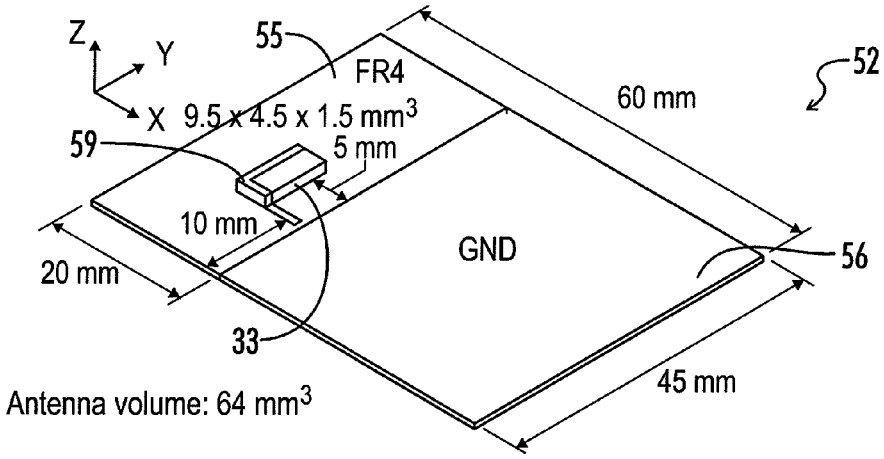
*FIG. 10*

Measured voltage standing wave ratio (VSWR) of fabricated BT1 antenna

Measured voltage standing wave ratio (VSWR) of fabricated BT2 antenna

Measured voltage standing wave ratio (VSWR) of fabricated UWB antenna

| Antennas | | Gain [dBi] | | Bandwidth [GHz] |
|---|---|---|---|---|
| | Dimensions | Peak | Average | (VSWR 2:1) |
| Bluetooth antenna | BT1: 9.5 X 4.5 X 1.5 $mm^3$ | -1.12 at 2.45 GHz | -4.02 at 2.45 GHz | 0.78 (2.13 ~ 2.91) |
| | BT2: 10 X 5 X 2 $mm^3$ | 0.71 at 2.45 GHz | -2.49 at 2.45 GHz | 0.84 (2.11 ~ 2.95) |
| Ultra-wide band antenna | UWBI: 9.8 X 9 X 1.5 $mm^3$ | 2.19 at 4.6 GHz | -2.19 at 4.6 GHz | 2.24 (2.66 ~ 4.9) |

M-TYPE HEXAFERRITE ANTENNAS FOR USE IN WIRELESS COMMUNICATION DEVICES

CROSS REFERENCE TO RELATED APPLICATION

This is a national stage application of and claims priority to International Application No. PCT/US11/60851, entitled "M-Type Hexaferrite Antennas for Use in Wireless Communication Devices" and having an international filing date of Nov. 15, 2011, which is incorporated herein by reference. International Application No. PCT/US11/60851 claims priority to U.S. Provisional Patent Application No. 61/413,866, entitled "Tin (Sn) and Zinc (Zn) Substituted M-Type Hexaferrite for GHz Chip Antenna Applications" and filed on Nov. 15, 2010, which is incorporated herein by reference.

RELATED ART

High-performance, broadband antennas have become important components in wireless communication systems. Further, miniaturization of such antennas with small form factors is increasingly important as the sizes of mobile communication devices decrease. Accordingly, there is an increased interest in magneto-dielectric antennas since magneto-dielectric materials (ferrites) possess both high permeability ($\mu_r$) and high permittivity ($\epsilon_r$). A wavelength inside the magneto-dielectric material gets shorter according to $\lambda_{eff}=c/f\sqrt{(\mu_r \epsilon_r)}$. Antenna bandwidth (BW) increases with $\mu_r$ of the relationship BW $\propto\sqrt{(\mu_r/\epsilon_r)}$. Therefore, both permeability and permittivity of a ferrite have significant contributions to antenna performance.

In general, spinel ferrite has a higher permeability than hexagonal ferrites but is limited to low-frequency range antenna applications due to its large high-frequency magnetic loss. This is due primarily to the fact that magnetic loss suddenly increases near the ferromagnetic resonance (FMR) frequency. For gigahertz (GHz) antenna applications, the FMR frequency of a ferrite generally should be higher than the resonant frequency ($f_r$) of the antenna.

It is noted that high $H_k$ of ferrite leads to high FMR according to FMR=$(\gamma/2\pi)H_k$, where $H_k$ is the magnetocrystalline anisotropy field and $\gamma$ is the gyromagnetic ratio. Therefore, hexagonal ferrite is a good candidate for GHz antenna substrates because it possesses a high $H_k$, thereby a high FMR frequency. Soft $Co_2Z$ hexaferrite ($Ba_3Co_2Fe_{24}O_{41}$) has been developed for terrestrial digital media broadcasting (T-DMB: 174-216 MHz) antenna applications. However, the $Co_2Z$ has disadvantages, such as high synthetic temperature of about 1200 Celsius (° C.) and complex phase transformation. On the other hand, pure M-type hexaferrite (SrM: $SrFe_{12}O_{19}$) has a simple crystal structure that is thermodynamically stable. Therefore, the M-type hexaferrite can be produced at a relatively low temperature of around 900° C. However, SrM is magnetically hard and shows low permeability due to its high magnetocrystalline anisotropy. For at least this reason, M-type hexaferrite (SrM: $SrFe_{12}O_{19}$) is not typically used for GHz antenna applications.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 8 depicts a table summarizing magnetic properties for synthesized tin (Sn) and zinc (Zn) substituted M-type strontium hexaferrite (Sn/Zn-substituted SrM: $SrFe_7Zn_{2.5}Sn_{2.5}O_{19}$).

FIG. 9 depicts an exemplary embodiment of a wireless communication apparatus.

FIG. 10 depicts an exemplary embodiment of a chip antenna system for a wireless communication apparatus, such as is depicted in FIG. 9.

DETAILED DESCRIPTION

The present disclosure generally pertains to antenna materials that are particularly suited for high frequency (e.g., GHz) applications. In one embodiment, an antenna is fabricated using an M-type hexaferrite, such as a tin (Sn) and zinc (Zn) substituted M-type strontium hexaferrite (Sn/Zn-substituted SrM: $SrFe_{12-2x}Zn_xSn_xO_{19}$), thereby enabling antenna miniaturization, broad bandwidth, and high gain. In one exemplary embodiment, the value of "x" in the compound $SrFe_{12-2x}Zn_xSn_xO_{19}$ is between 2 and 5, but other values of "x" are possible in other embodiments. Some of the Fe cations in M-type strontium hexaferrite (SrM: $SrFe_{12}O_{19}$) are substituted with tin (Sn) and zinc (Zn) to achieve soft magnetic properties for the antenna. Thus, the coercivity and permeability are lower and higher, respectively, than those of pure SrM. Such fabricated hexaferrite chip antennas have broadband characteristics and show good radiation performance at various frequencies, including in the GHz frequency range. In one embodiment, a Sol-gel process is employed to synthesize Sn/Zn-substituted SrM ferrite. The price of substitution elements of Sn and Zn is less expensive than cobalt (Co) in the Z-type hexaferrite ($Ba_3Co_2Fe_{24}O_{41}$), and the use of Sn/Zn-substituted SrM ferrite is more cost-effective than the Z-type hexaferrite.

Figure 1:
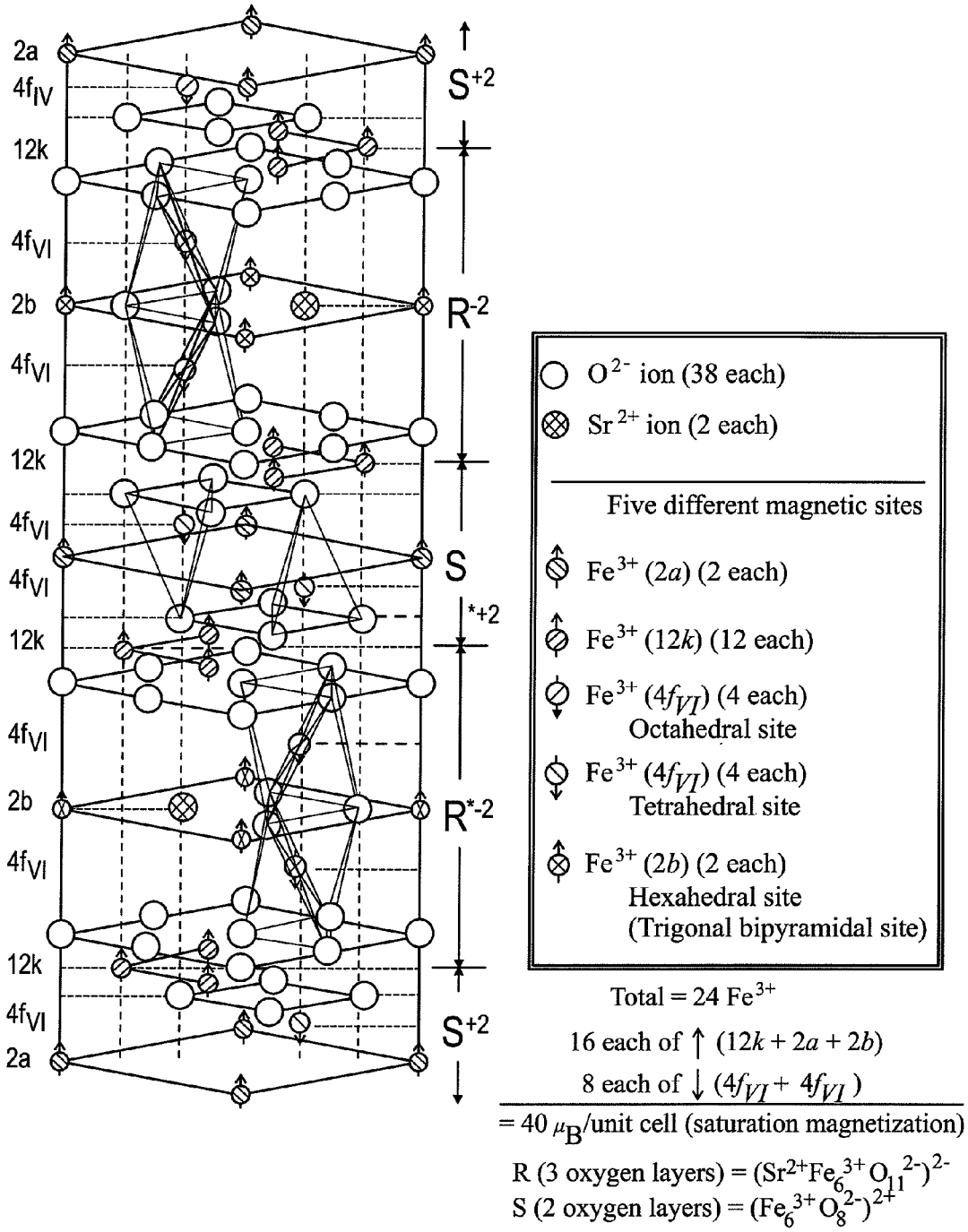
FIG. 1 depicts a crystalline structure of M-type Sr-hexaferrite ($SrFe_{12}O_{19}$) and spin directions for $Fe^{3+}$ sites.

Referring to FIG. 1, iron cations ($Fe^{3+}$) occupy five different crystallographic sites in pure strontium (barium) hexaferrite. There are 24 $Fe^{3+}$ magnetic cations in a unit cell of Sr (or Ba)-hexaferrite. Among these, $Fe^{3+}$ at the 2b site has the highest magneto crystallineanisotropy, thereby leading to hard magnetic property. Magnetic spin directions of $Fe^{3+}$ cations at 4f sites are downward opposing the directions of other sites. The magnetization per unit cell is about 40 Bohr magnetons ($\mu_B$). In one embodiment, part of $Fe^{3+}$ cations at 4f and 2b are substituted by non-magnetic Sn and Zn cations. The substitutions cancel spin-down of $Fe^{3+}$ cations at 4f sites, resulting in an increase in the saturation magnetization. The substitution for 2b sites leads to low magnetocrystalline anisotropy, therefore, becoming soft.

An exemplary synthetic Sol-gel process for fabricating Sn/Zn-substituted SrM ferrite ($SrFe_{12-2x}Zn_xSn_xO_{19}$) will now be described with particular reference to FIG. 2. However, it should be emphasized that other types of processes may be used to fabricate such material.

Figure 2:
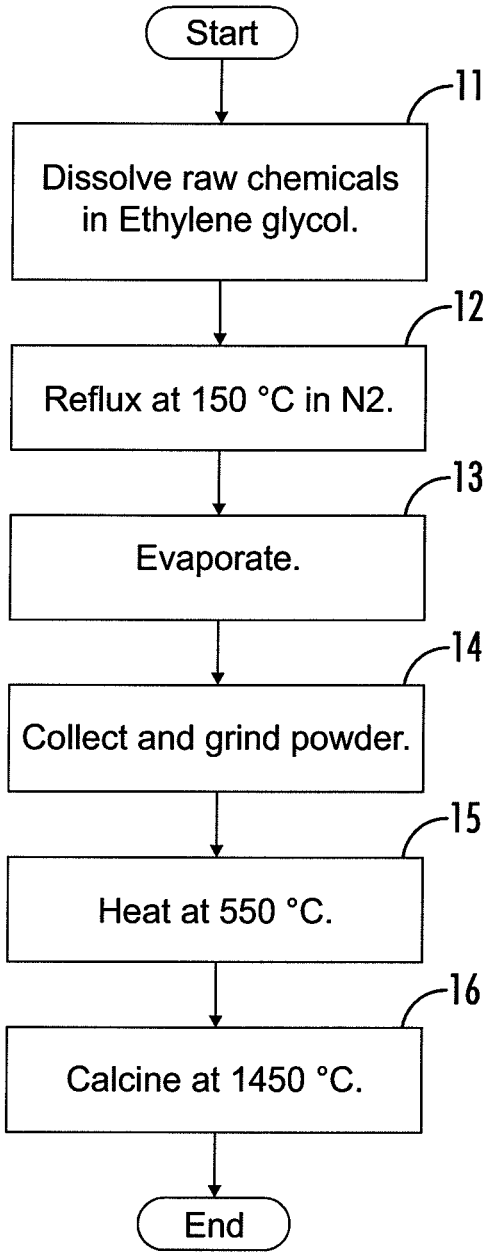
FIG. 2 is a flowchart illustrating an exemplary process for making tin (Sn) and zinc (Zn) substituted M-type strontium hexaferrite (Sn/Zn-substituted SrM: $SrFe_7Zn_{2.5}Sn_{2.5}O_{19}$) powder.
Figure 3:
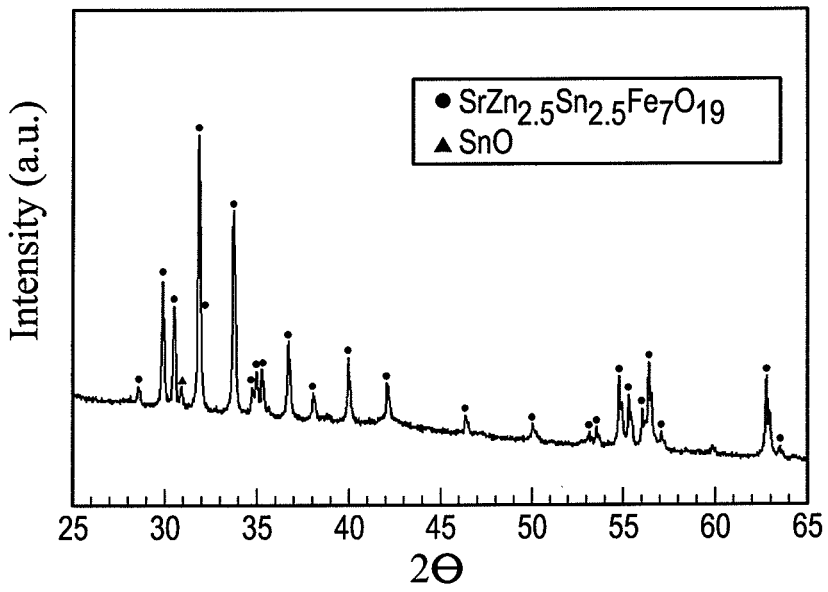
FIG. 3 depicts X-ray diffraction spectra for synthesized tin (Sn) and zinc (Zn) substituted M-type strontium hexaferrite (Sn/Zn-substituted SrM: $SrFe_7Zn_{2.5}Sn_{2.5}O_{19}$) particles.

As shown by block 11 of FIG. 2, stoichimetric amounts of raw chemicals ($SrCl_{2\cdot6}H_2O$, $FeCl_{3\cdot6}H_2O$, $SnCl_4\cdot xH_2O$, and $ZnCl_2$) are dissolved in Ethylene glycol with about 12 hours (h) of magnetic stirring. As shown by block 12, the dissolved solution is refluxed at about 150° C. for about 2 hours in $N_2$. As shown by block 13, the refluxed solution is evaporated on a hot plate at about 200° C. until complete evaporation. The evaporated powder is then collected and grinded, as shown by block 14. The powder is then heated at about 550° C. to decompose the organic precursors in a fume hood, as shown by block 15. The powder is then calcined at about 1450° C. in a furnace, as shown by block 16. Using such process, synthesized hexaferrite powder has been confirmed by X-ray diffraction patterns, as shown in FIG. 3.

Figure 4:
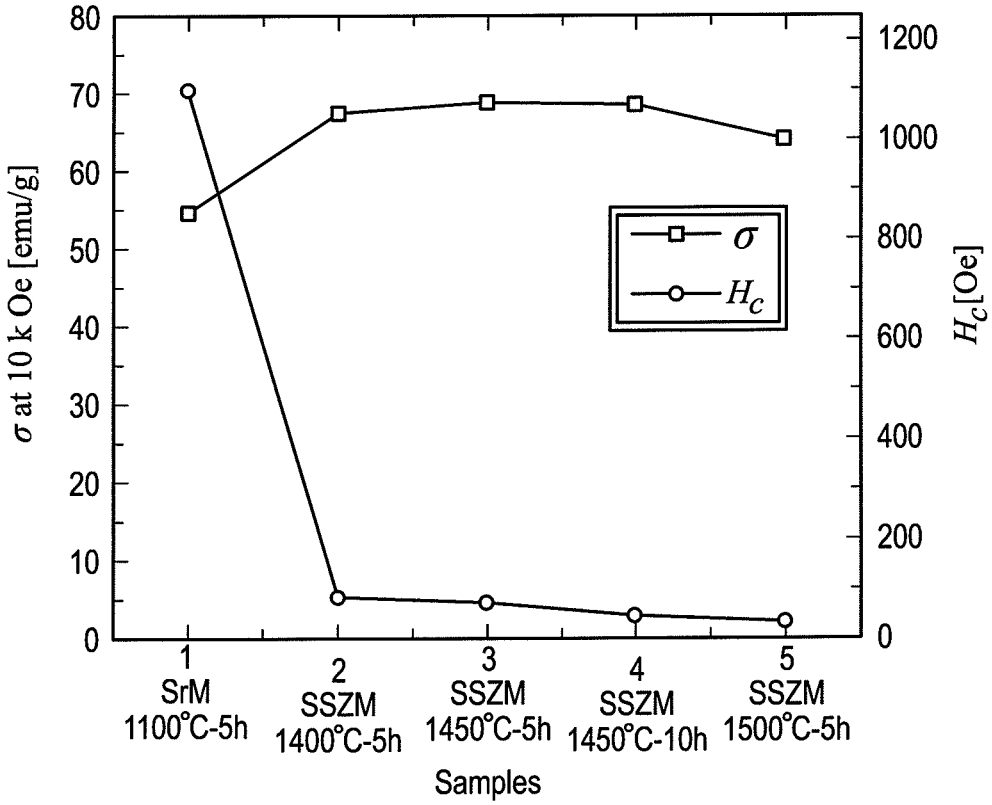
FIG. 4 depicts magnetization and coercivity for synthesized tin (Sn) and zinc (Zn) substituted M-type strontium hexaferrite (Sn/Zn-substituted SrM: $SrFe_7Zn_{2.5}Sn_{2.5}O_{19}$) particles.

FIG. 4 shows magnetic properties of pure SrM and Sn/Zn-substituted SrM (SSZM: $SrFe_7Sn_{2.5}Zn_{2.5}O_{19}$) heat-treated at various temperatures. Coercivity ($H_c$), otherwise magnetic hardness, decreases with substituting Sn and Zn for Fe in M-type hexaferrite, while maintaining higher saturation magnetization ($\sigma_s$) than the pure SrM. This is because the down-spin of the 4f site and magnetic anisotropy of the 2b site are occupied by Sn and Zn cations. Accordingly, the coercivity for SSZM dramatically decreases to about 34 Oe from about 1100 Oe of the pure SrM. It is noted that SSZN becomes soft. Therefore, higher permeability than that of magnetically hard pure SrM is expected, which is desired for high frequency (e.g., GHz) antenna applications.

Figure 5:
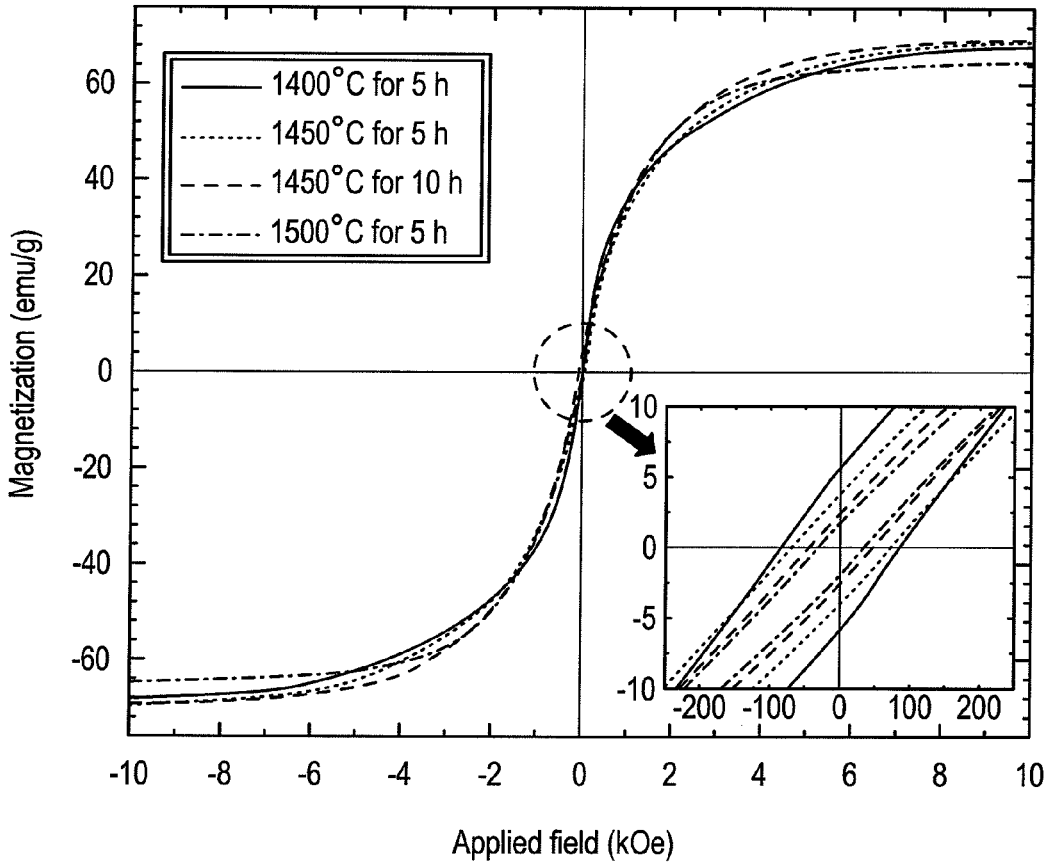
FIG. 5 depicts magnetic hysteresis loops for synthesized tin (Sn) and zinc (Zn) substituted M-type strontium hexaferrite (Sn/Zn-substituted SrM: $SrFe_7Zn_{2.5}Sn_{2.5}O_{19}$) particles by various heat-treatment conditions.

FIG. 5 shows magnetic hysteresis loops of SSZM powder heat-treated at three different temperatures. The lowest coercivity of about 33.89 Oe is obtained for about 1500° C. (5 hour) sample, while the 1450° C. (5 hour) sample shows the highest magnetization of about 68.72 emu/g. High permeability can be achieved with high saturation magnetization and low coercivity. Therefore, the 1450° C. (10 hour) sample is chosen for antenna fabrication in one exemplary embodiment, though other samples may chosen for other embodiments. Magnetic properties of SSZN are summarized in FIG. 8. The following numerical analysis of the magnetization (M) curve was used to estimate the magnetic anisotropy field ($H_\alpha$) of SSZM powder.

$$M = M_s\left(1 - \frac{H_a^2}{15H^2}\right) + \chi_p H \tag{1}$$

$$H_a = \frac{2K_1}{M_s} = \frac{[\text{erg/cm}^3]}{[\text{emu/cm}^3]} = \frac{[\text{erg}]}{[\text{emu}]} = \frac{[\text{erg}]}{\left[\frac{\text{erg}}{\text{Oe}}\right]} = [\text{Oe}] \tag{2}$$

where $M_s$ is the saturation magnetization, $H_a$ is the magnetic anisotropy field, $X_p$ is the high field differential susceptibility, H is the applied field reduced by the demagnetization field and $K_1$ is the anisotropy constant. The $H_a$ of about 4.75 kOe was obtained for the SSZM (heat-treated at about 1450° C. for about 10 h) sample by fitting the hysteresis loop to Eq. (1). This magnetic anisotropy field results in ferromagnetic resonance (FMR) frequency of about 13.2 GHz according to Eq. (3).

$$f_{resonance} = \gamma(H_0 + H_a)$$

$$f_r = (2.8\ \text{MHz/Oe}) \times (H_0 + H_a) \tag{3}$$

where $H_0$ is the applied bias field, $H_a$ is the anisotropy field, and $\gamma$ is the gyromagnetic ratio.

Figure 6:
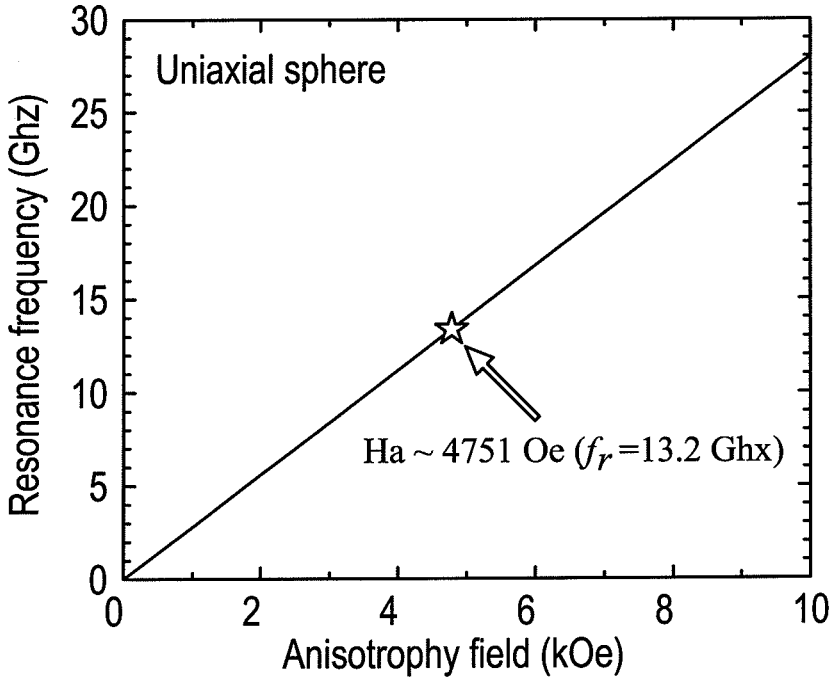
FIG. 6 depicts calculated ferromagnetic resonance (FMR) frequency against anisotropy field of synthesized tin (Sn) and zinc (Zn) substituted M-type strontium hexaferrite (Sn/Zn-substituted SrM: $SrFe_{12-2x}Zn_xSn_xO_{19}$).

FIG. 6 shows the anisotropy dependence of the ferromagnetic resonance frequency. The star mark in FIG. 6 represents that the SSZM can be applicable up to about 13.2 GHz.

Figure 7A:
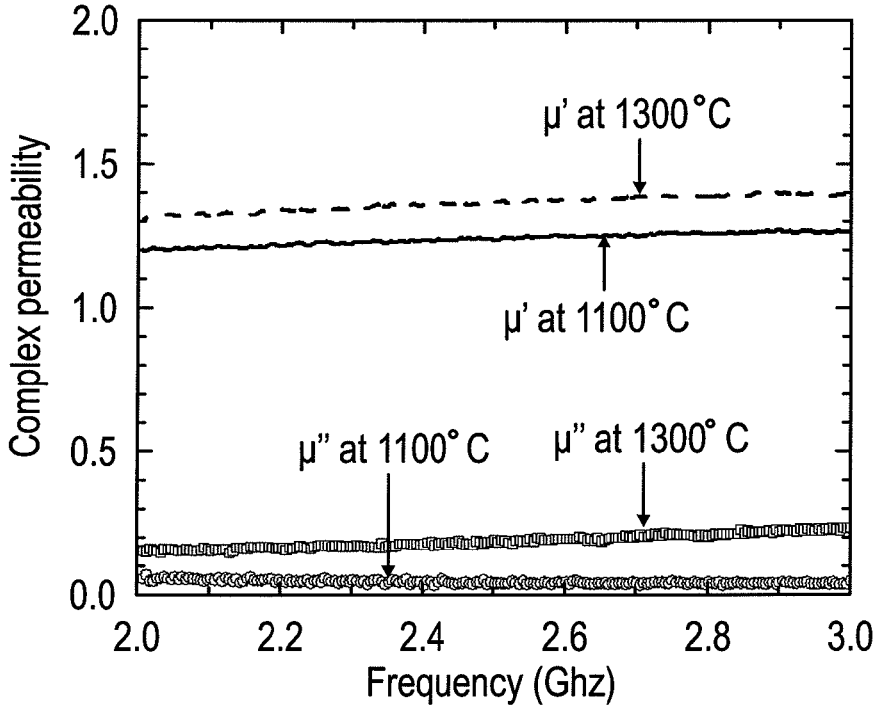
FIG. 7A depicts measured permeability spectra for synthesized tin (Sn) and zinc (Zn) substituted M-type strontium hexaferrite (Sn/Zn-substituted SrM: $SrFe_7Zn_{2.5}Sn_{2.5}O_{19}$).
Figure 7B:
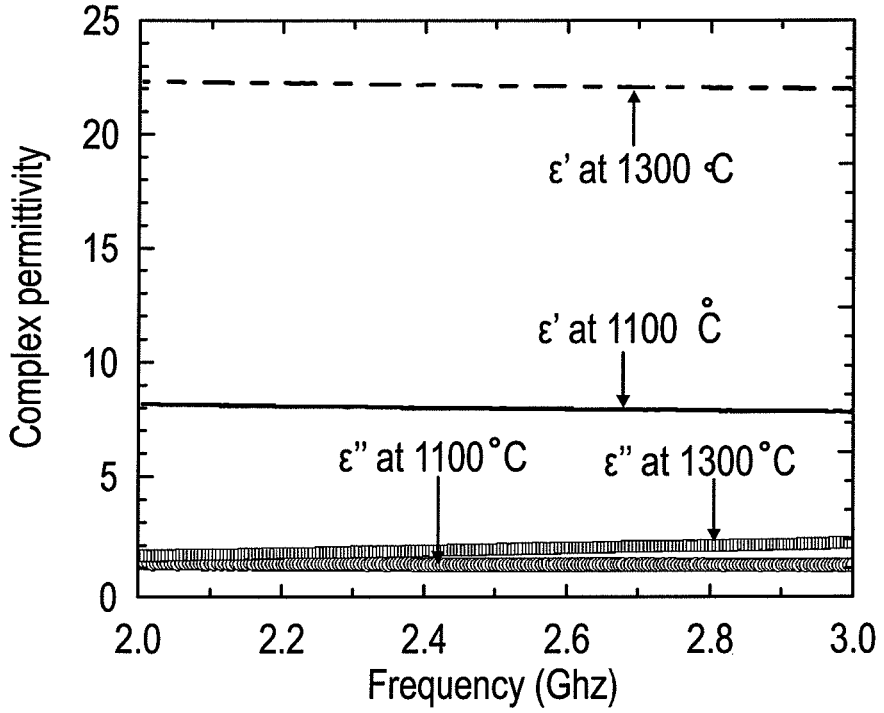
FIG. 7B depicts measured permittivity spectra for synthesized tin (Sn) and zinc (Zn) substituted M-type strontium hexaferrite (Sn/Zn-substituted SrM: $SrFe_7Zn_{2.5}Sn_{2.5}O_{19}$).

FIG. 7A and FIG. 7B represent complex permeability and permittivity, respectively, of SSZM (1450° C. for 10 h) sample. The real parts of permeability and permittivity of the 1300° C. sintered ferrite were 1.37 (loss tan $\delta_\mu$=13%) and 22.2 (loss tan $\delta_\epsilon$=10%) at 2.45 GHz, respectively. Magnetic and dielectric loss tangents can be reduced with employing sintering agent such as $Bi_2O_3$, etc.

FIG. 9 depicts an exemplary embodiment of a wireless communication device 25, such as a cellular telephone, having a transceiver 29 that is coupled to an antenna 33. In one exemplary embodiment, the transceiver 29 is configured for communication in the GHz frequency range, and desirably for such GHz applications, the FMR frequency of ferrite substrate of the antenna 33 is higher than the resonant frequency of the antenna 33. However, other frequencies are possible in other embodiments.

FIG. 10 depicts an antenna system 52 having a chip antenna 33, such as is depicted by FIG. 9. The antenna system 52 has a substrate 55, which is composed of copper clad laminate (CCL) FR4, though other types of substrate materials may be used in other embodiments. As shown by FIG. 10, formed on a portion of the substrate 55 is a conductive layer 56, which is coupled to ground (GND) of the device 25 in which the antenna system 52 is used. The antenna 33 is also formed on the substrate 55, as shown by FIG. 10. A radiator 59 (forming a flat conductive trace) is formed on the ferrite substrate of antenna 33 and a portion of the substrate 55. In one exemplary embodiment, the conductive layer 56 and the radiator 59 are both composed of copper, but other conductive materials may be used in other embodiments. The radiator 59 is conductively coupled to the transceiver 29 (FIG. 10). For example, as will be described in more detail hereafter, the radiator 59 may be coupled to a coaxial cable (not shown in FIG. 10) that extends to the transceiver 29.

In one exemplary embodiment, the antenna 33 is composed of tin (Sn) and zinc (Zn) substituted M-type strontium hexaferrite (Sn/Zn-substituted SrM: $SrFe_{12-2x}Zn_xSn_xO_{19}$), where x has a value between 2 and 5, though other values of x may be used in other embodiments. Further, the chip antenna 33 has a length of 9.5 millimeters (mm), a width of 4.5 mm, and a thickness of 1.5 mm, although other dimensions are possible in other embodiments. With the dimensions shown, the chip antenna 33 is suitable for use as a Bluetooth 1 (BT1) antenna.

Figure 11A:
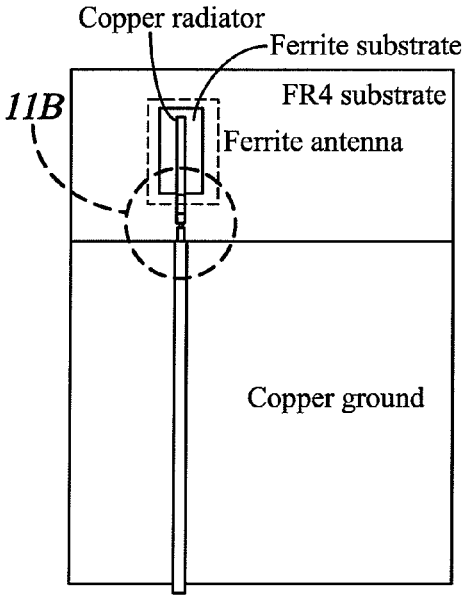
FIG. 11A depicts a top view of the antenna system depicted by FIG. 10 after a coaxial cable has been attached to components of the antenna system.
Figure 11B:
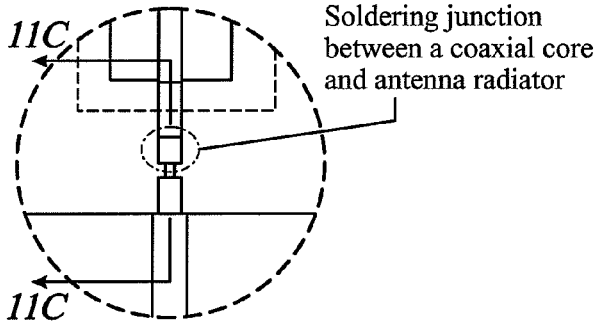
FIG. 11B depicts an enlarged view of an end of the coaxial cable depicted in FIG. 11A.
Figure 11C:
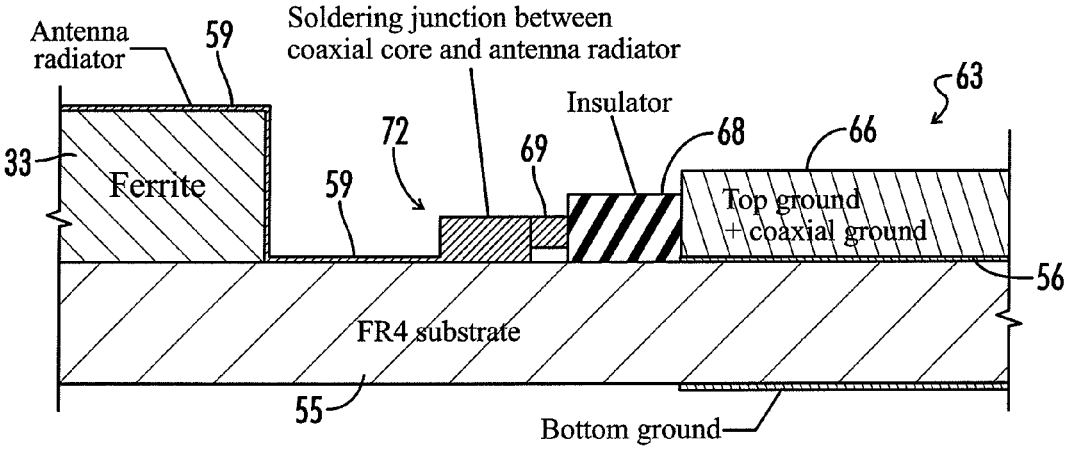
FIG. 11C depicts a cross-sectional view of the chip antenna system of FIG. 10.

FIGS. 11A-C show the antenna system 52 of FIG. 10 after a coaxial cable 63 has been coupled to the chip antenna 33 to provide a conductive path between the antenna radiator 59 and another component, such as transceiver 29 (FIG. 9). As shown by FIG. 11C, the coaxial cable 63 has an outer conductor 66 that is coupled (e.g., soldered) to the conductive layer 56. Within the outer conductor 66 is an insulator 68 that surrounds an inner core 69 of conductive material. This inner core 69 is soldered to the radiator 59 at a soldering junction 72. Various other configurations of the antenna system 52 with the antenna 33 are possible in other embodiments.

Figure 12A:
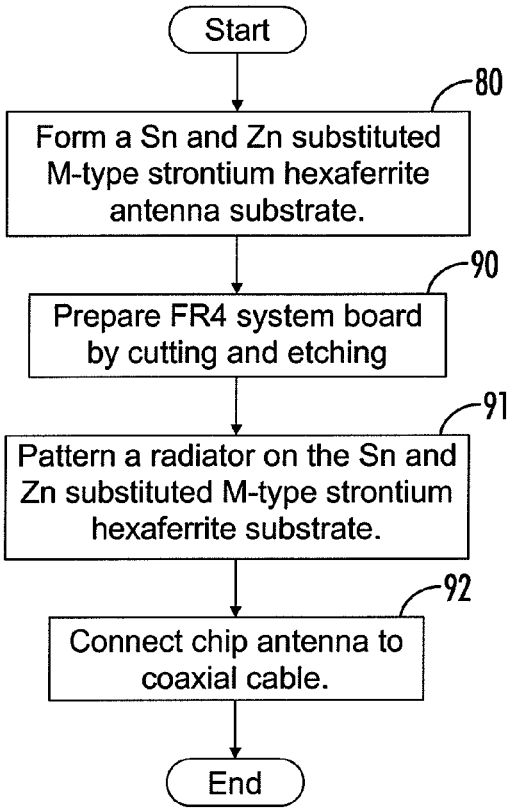
FIGS. 12A and 12B are flowcharts illustrating exemplary processes for forming an antenna system having a synthesized tin (Sn) and zinc (Zn) substituted M-type strontium hexaferrite (Sn/Zn-substituted SrM: $SrFe_7Zn_{2.5}Sn_{2.5}O_{19}$) antenna.
Figure 12B:
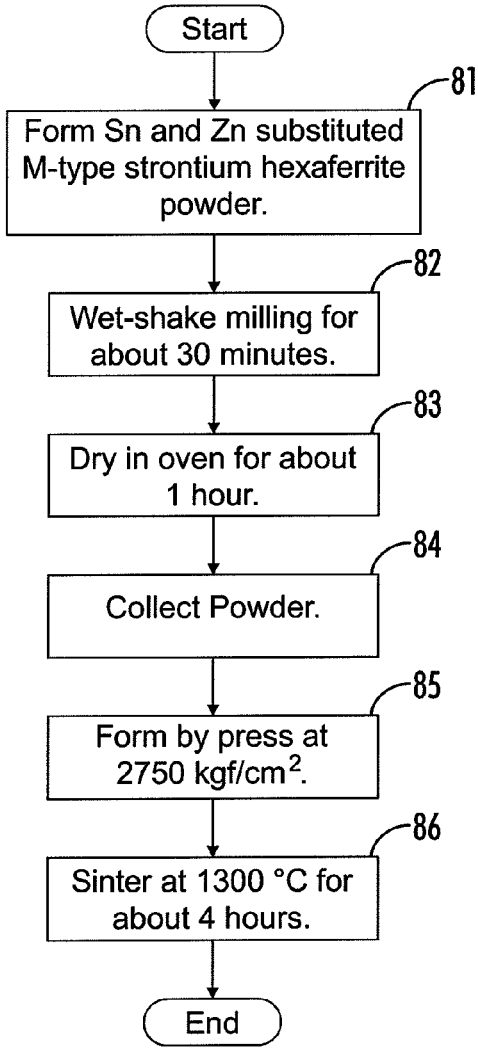

An exemplary process for fabricating the exemplary chip antenna 33 and the system 52 shown by FIG. 10 will be described below with reference to FIGS. 12A and 12B. Once a chip antenna is designed, a tin (Sn) and zinc (Zn) substituted M-type strontium hexaferrite antenna substrate is formed, as shown by block 80 of FIG. 12A. An exemplary process of performing block 80 is shown by FIG. 12B. In this regard, as shown by block 81 of FIG. 12B, tin (Sn) and zinc (Zn) substituted M-type strontium hexaferrite powder is formed according to the process depicted by FIG. 2. Wet-shake milling is then performed on the powder for about 30 minutes, as shown by block 82. The powder is then dried in an oven for about one hour and collected, as shown by blocks 83 and 84. Using such powder, a ferrite substrate of the antenna 33 is formed by press at about 2750 kgf/cm$^2$, as shown by block 85, and then is sintered at about 1300° C. for about 4 hours, as shown by block 86. Once the ferrite substrate of the antenna 33 is formed, an FR4 system board (e.g., substrate 55) is prepared by cutting and etching, as shown by block 90 of FIG. 12A, and the radiator 59 formed via conventional microfabrication techniques, such as patterning and etching, as shown by block 91. After the radiator 59 is formed, chip antenna 33 is connected to a coaxial cable 63, as shown by block 92. In particular, the outer conductor 66 of the coaxial cable 63 is soldered to the conductive layer 56, and the inner core 69 of the coaxial cable 63 is soldered to the radiator 59.

Figure 13:
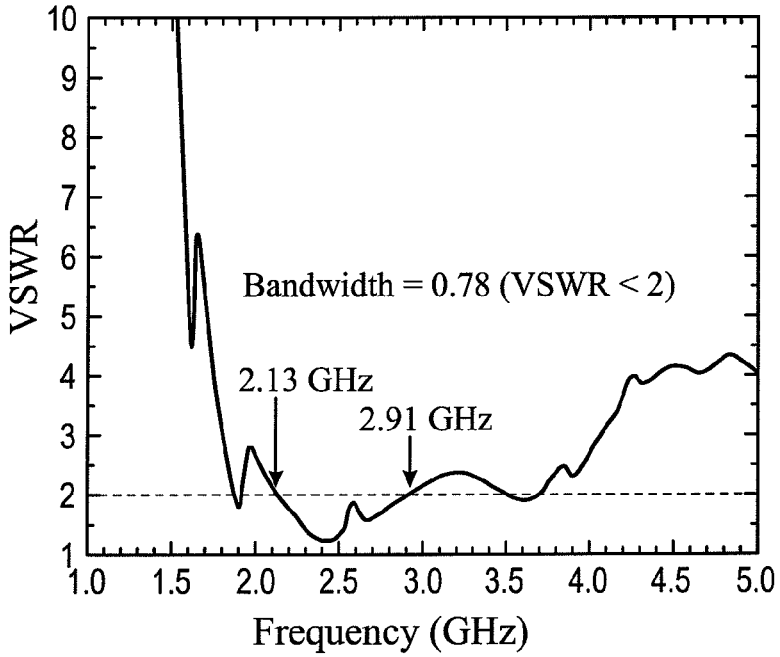
FIG. 13 depicts measured voltage standing wave ratio (VSWR) of a fabricated antenna depicted by FIG. 10.
Figure 14:
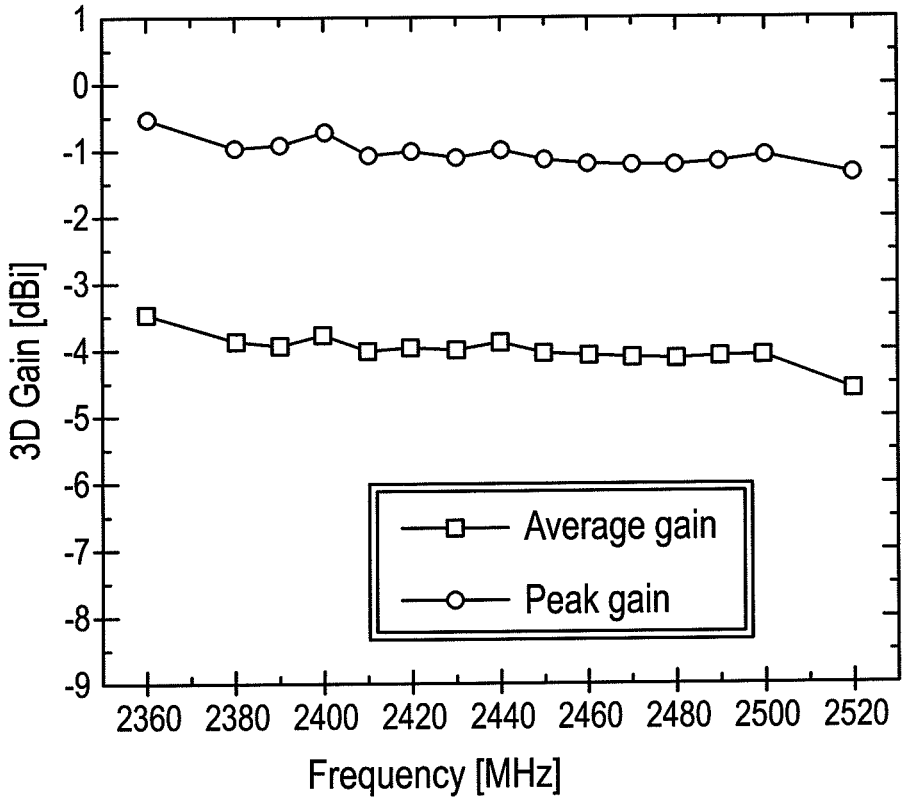
FIG. 14 depicts measured average and peak gain of a fabricated antenna depicted by FIG. 10.

FIG. 13 presents measured voltage standing wave ratio (VSWR) of the antenna system 52 with the chip antenna 33 of FIG. 10, which is dimensioned for use as a BT1 antenna. The measure antenna bandwidth was found to be about 780 MHz (2.13~2.91 GHz) at VSWR=2:1. It is noted that the hexaferrite chip antenna shows broadband characteristics, which ensures robust operation of a mobile without a matching network. FIG. 14 presents measured antenna gain. The maximum 3D peak gain of about −0.52 dBi was obtained at about 2.36 GHz. At the Bluetooth center frequency 2.45 GHz, the 3D peak and average gains were about −1.12 dBi and −4.02 dBi, respectively. It is evident that the hexaferrite chip antenna provides a high performance and uniform radiation pattern over the wide frequency band.

Figure 15:
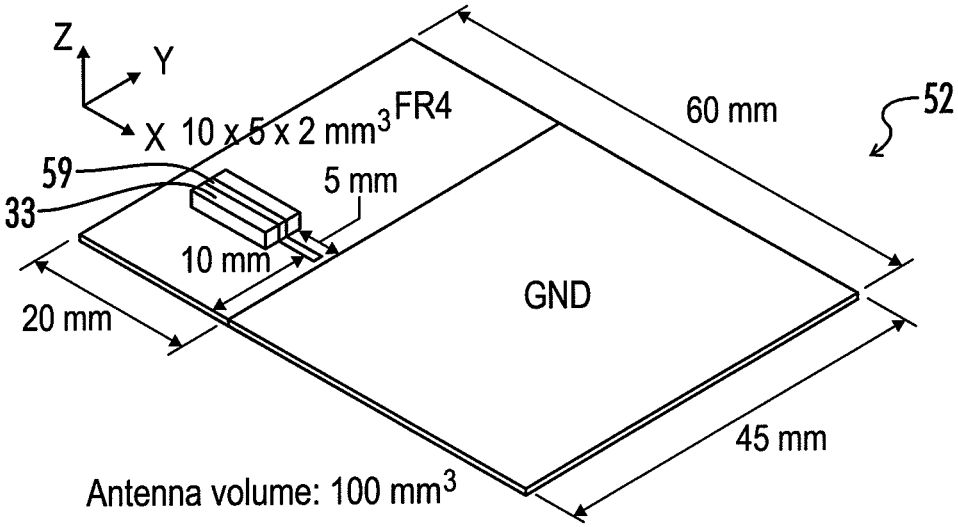
FIG. 15 depicts an exemplary embodiment of a chip antenna system for a wireless communication apparatus, such as is depicted in FIG. 9.
Figure 16:
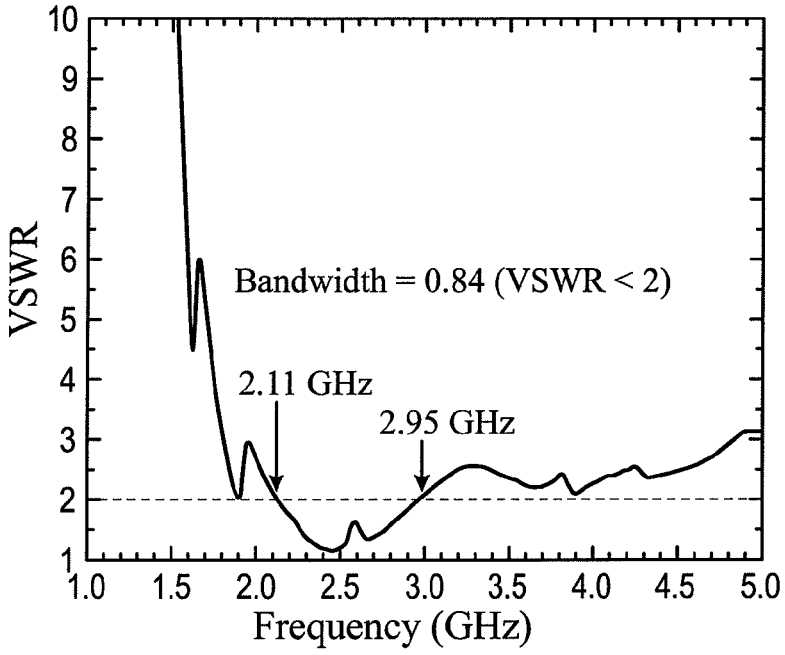
FIG. 16 depicts measured voltage standing wave ratio (VSWR) of a fabricated antenna depicted by FIG. 15.
Figure 17:
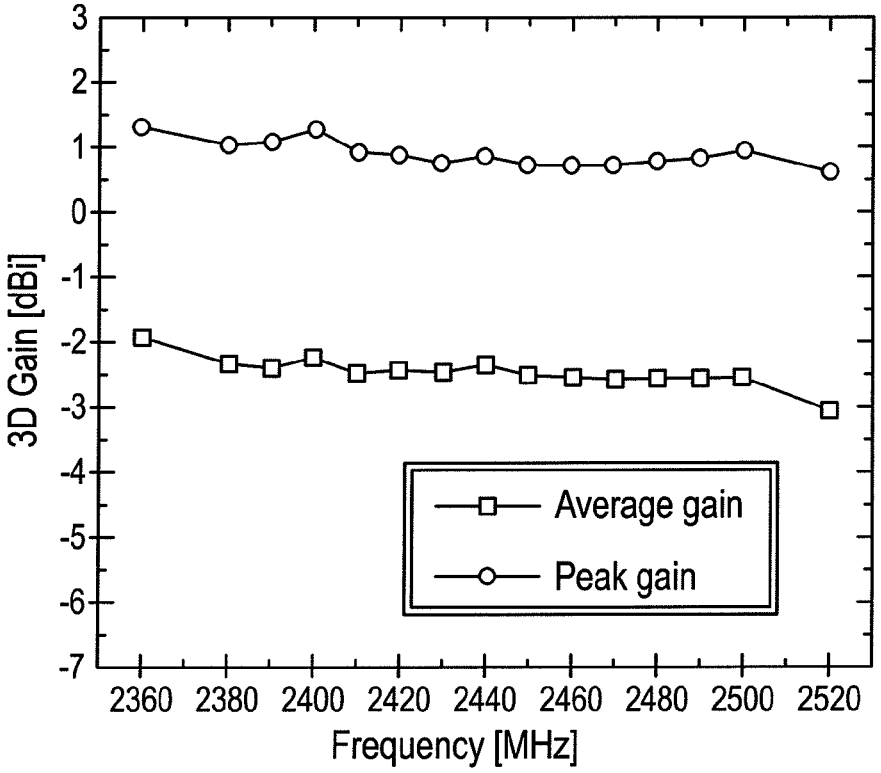
FIG. 17 depicts measured average and peak gain of a fabricated antenna depicted by FIG. 15.

FIG. 15 depicts another embodiment of an antenna system 52 that is configured similar to the one shown by FIG. 10 except that it is dimensioned for use as Bluetooth 2 (BT2) antenna. Measured VSWR (voltage standing wave ratio) of the BT2 antenna shown by FIG. 15 is presented in FIG. 16. The antenna bandwidth was obtained to be about 840 MHz (2.11~2.95 GHz) at VSWR=2:1. FIG. 17 shows measured antenna gain for the BT2 antenna shown by FIG. 15. The maximum 3D peak gain of about 2.36 dBi was obtained at about 2.36 GHz. At the Bluetooth center frequency 2.45 GHz, the 3D peak and average gains were about 0.71 dBi and −2.49 dBi, respectively.

Figure 18:
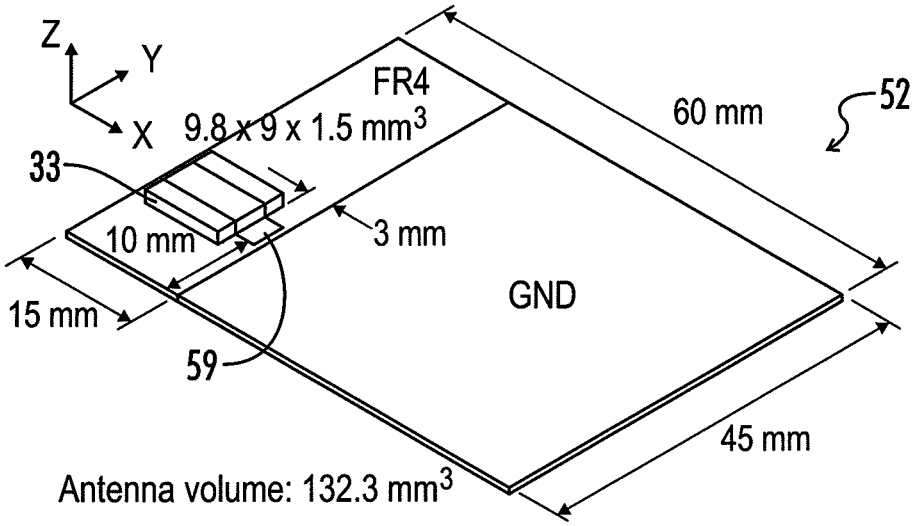
FIG. 18 depicts an exemplary embodiment of a chip antenna system for a wireless communication apparatus, such as is depicted in FIG. 9.
Figure 19:
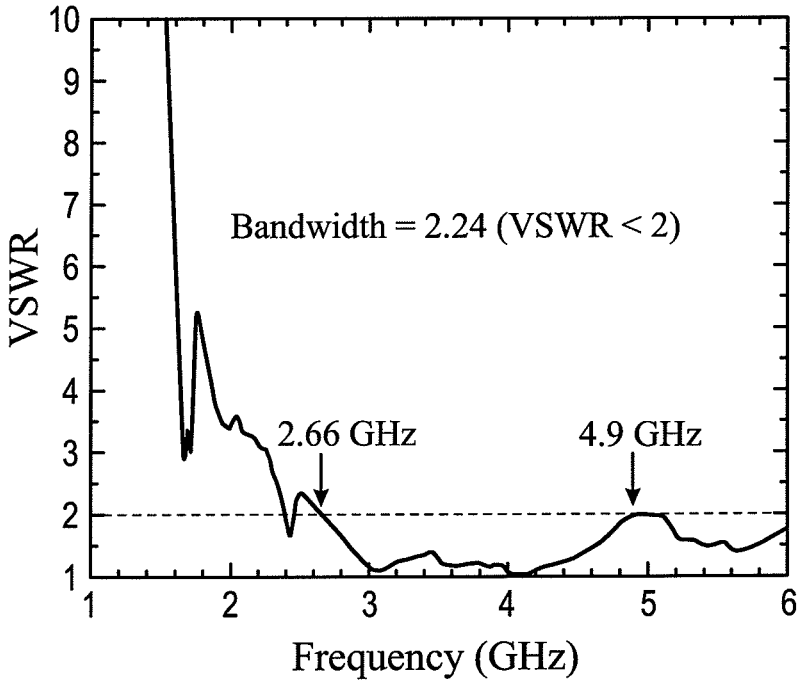
FIG. 19 depicts measured voltage standing wave ratio (VSWR) of a fabricated antenna depicted by FIG. 18.
Figures 20, 21:
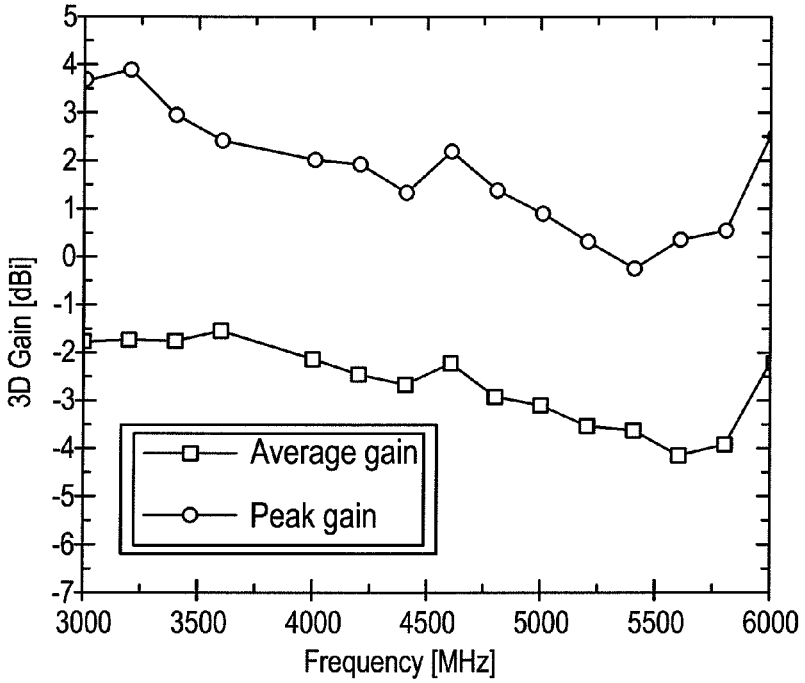
FIG. 20 depicts measured average and peak gain of a fabricated antenna depicted by FIG. 18.
FIG. 21 depicts a table summarizing antenna dimensions and measured performance of fabricated antennas depicted by FIGS. 10, 15, and 18.

FIG. 18 depicts another embodiment of an antenna system 52 that is configured similar to the one shown by FIG. 10 except that it is dimensioned for use as an ultra-wideband (UWB) antenna. FIG. 19 represents measured VSWR (voltage standing wave ratio) of the UWB antenna shown by FIG. 18. The antenna bandwidth was found to be about 2240 MHz (2.66~4.90 GHz) at VSWR=2:1. FIG. 20 shows antenna gain for the antenna shown by FIG. 18 in the frequency range of about 3 GHz to 6 GHz. The maximum 3D peak and average gains were about 3.89 dBi at 3.2 GHz and −1.55 dBi at 3.6 GHz, respectively.

The dimensions and measured performance of the fabricated hexaferrite chip antennas (BT1, BT2, and UWB) shown by FIGS. 10, 15, and 18 are summarized in FIG. 21. Yet other dimensions are possible in other embodiments.

Now, therefore, the following is claimed:

1. An antenna system for a wireless communication apparatus, comprising:

a substrate;

a chip antenna formed on the substrate, the chip antenna comprising a magnetically soft M-type hexaferrite, wherein the M-type hexaferrite comprises tin (Sn) and zinc (Zn) substituted M-type strontium hexaferrite; and a conductive radiator contacting the chip antenna.

2. An antenna system for a wireless communication apparatus, comprising:

a substrate;

a chip antenna formed on the substrate, the chip antenna comprising a magnetically soft M-type hexaferrite, wherein the M-type hexaferrite comprises $SrFe_{12-2x}Zn_xSn_xO_{19}$ where x is a value between 2 and 5; and a conductive radiator contacting the chip antenna.

3. The system of claim 1, wherein the conductive radiator is formed via microfabrication.

4. The system of claim 1, wherein a ferromagnetic resonance frequency of a ferrite substrate of the chip antenna is higher than a resonant frequency of the chip antenna.

* * * * *